United States Patent [19]

Barratt et al.

[11] Patent Number: 4,854,117

[45] Date of Patent: Aug. 8, 1989

[54] FRICTION SPINNING APPARATUS WITH SLUB CLEARING MEANS

[75] Inventors: Peter J. Barratt, Accrington; Douglas O. Clough; Peter J. Dickinson, both fo Rossendale; William M. Farnhill, Burnley, all of England

[73] Assignee: Hollingsworth (U.K.), Ltd., Accrington, England

[21] Appl. No.: 5,371

[22] Filed: Jan. 12, 1987

Related U.S. Application Data

[63] Continuation-in-part of Ser. No. 791,388, Oct. 25, 1985, abandoned.

[30] Foreign Application Priority Data

Oct. 26, 1984 [GB] United Kingdom ..... 8427110

[51] Int. Cl.[4] ..... D01H 7/882; D01H 11/00

[52] U.S. Cl. ..... 57/301; 57/304; 57/401

[58] Field of Search ..... 57/300, 301, 302, 304, 57/400, 401

[56] References Cited

U.S. PATENT DOCUMENTS

| | | | |
|---|---|---|---|
| 3,760,577 | 9/1973 | Kihara et al. | 57/302 |
| 3,986,328 | 10/1976 | Harrap | 57/301 |
| 4,038,812 | 8/1977 | Stahlecker | 57/301 |
| 4,315,398 | 2/1982 | Parker et al. | 57/401 |
| 4,380,892 | 4/1983 | Parker et al. | 57/301 X |
| 4,514,972 | 5/1985 | Stahlecker | 57/301 |
| 4,514,973 | 5/1985 | Stahlecker | 57/301 |

FOREIGN PATENT DOCUMENTS

| | | | |
|---|---|---|---|
| 0052412 | 5/1982 | European Pat. Off. | 57/401 |

*Primary Examiner*—Joseph J. Hail, III

*Attorney, Agent, or Firm*—Cort Flint

[57] ABSTRACT

Slubs are removed from an open-end spinning chamber by the application of suction to a debris-extraction duct by a valve opened to a suction line as the chamber is opened to a suction line as the chamber is opened for cleaning.

7 Claims, 2 Drawing Sheets

FRICTION SPINNING APPARATUS WITH SLUB CLEARING MEANS

CROSS REFERENCE TO RELATED APPLICATIONS

This application is a continuation-in-part to our application 06/791388 filed Oct. 25, 1985 now abandoned.

FIELD OF THE INVENTION

The present invention relates to friction spinning apparatus, and in particular to such apparatus which incorporates a means for cleaning the spinning unit in the event of a yarn break.

PRIOR ART

Our Published European Patent Application No. 0 052 412 assigned to the same Assignees as the present invention discloses a friction spinning apparatus including a pair of co-operating friction spinning rollers which define a yarn formation line along a nip between the two rollers. Although, in said earlier European Patent Application, the rollers are cylindrical and are on parallel axes, they could be of any other suitable shape but still defining a friction spinning nip; for example it is possible for the rollers to be skew axis hyperboloidal rotors.

The apparatus disclosed in Published European Patent Application No. 0 052 412 includes means for separating the two friction spinning rollers for the purposes of gaining access to the yarn formation nip to clear away fibrous debris in the event of a yarn break.

OBJECT OF THE INVENTION

It is an object of the present invention to facilitate clearing of debris from the spinning unit.

SUMMARY OF THE INVENTION

Accordingly, the present invention provides a friction spinning unit including means for opening the spinning unit for gaining access in order to remove fibrous debris in the event of a yarn break; a debris receptacle in communication with the space around the spinning zone to receive debris from the spinning unit; and means for removing collected debris from said receptacle. Advantageously the debris-removing means is a suction line and shut-off valve, actuated in response to opening of the spinning unit.

Preferably the means for opening the unit includes means for separating the two friction spinning rotors in order to gain access to the nip line, the rotor separating means being operatively connected to said means for controlling the application of suction to the suction duct. Preferably, the means for controlling the application of suction to the suction duct comprise a shut-off valve mechanically connected to the rotor separating mechanism.

With such apparatus small clumps of fibres are removed from the yarn formation line, as is envisaged by the progressive shut-off of suction during rotation of the inner masking sleeve with its parallelogram-shaped slot in the case of the friction spinning apparatus already described and claimed in said earlier Published European Patent Application No. 0 052 412, the entire disclosure of which is incorporated herein by reference. Also larger slubs can fall well clear of the friction spinning rollers by virtue of the presence of said suction duct. The machine operative merely needs to open the friction spinning unit and advantageously in so doing he or she lifts one of the friction spinning rotors away from the other to expose the nip line, and automatically any slubs in the spinning unit fall clear. The operative is then able to clear away any remaining small fibrous debris which may already have been drawn towards one end of the spinning unit, as disclosed in said earlier European Application.

BRIEF DESCRIPTION OF THE DRAWINGS

In order that the present invention may more readily be understood the following description is given, merely by way of example, with reference to the accompanying drawings in which.

In the drawings, those components which are identical between the two embodiments have the same reference numerals whereas the components which are modified in FIGS. 3 and 4 have their reference numerals increased by one hundred.

DESCRIPTION OF THE PREFERRED EMBODIMENT

Figure 1:
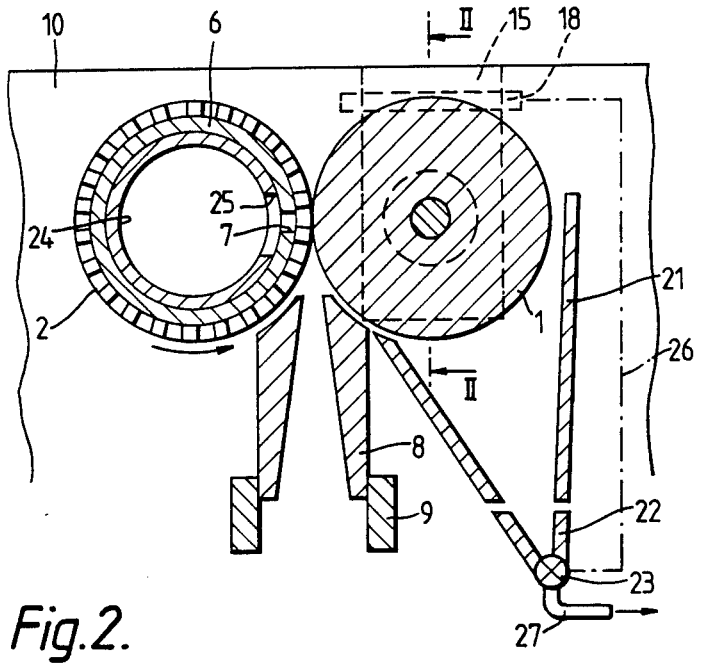
FIG. 1 is a transverse section of a friction spinning apparatus, illustrated in very schematic form, and constructed in accordance with the present invention, FIG. 1 being a section taken on line I—I of FIG. 2.

FIG. 1 shows a friction spinning unit comprising a solid roller 1 mounted on an axis parallel to that of a perforated roller 2. Roller 2 comprises a foraminous outer sleeve enclosing an intermediate masking sleeve 6 defining a suction slot 7, and an inner masking sleeve 24 defining a masking slot 25 operative as a valve to control shut-off of suction to the suction slot 7 and having the possibility of progressively shutting-off suction from one end of the normally parallel-sided suction slot 7 towards the other, for the purposes of roller cleaning and piecing, as adequately disclosed in said Published European Patent Application No. 0 052 412.

In use of the apparatus, an airborne stream of fibres from a fibre-separating unit 9 is projected upwardly from below along the fibre feed duct 8 towards the nip between the two rollers 1 and 2 which are rotating in the anti-clockwise sense, as shown by the arrow alongside the perforated cylinder 2.

When cleaning of the spinning unit is required, the body portion 15 of the casing 10 of the friction spinning unit is pivoted on a pivot pin 18 and allows lifting of the solid roller 1 by pivoting of a carrier for the roller 1, the pivot pin 18 being near one end of that carrier.

Figure 2:
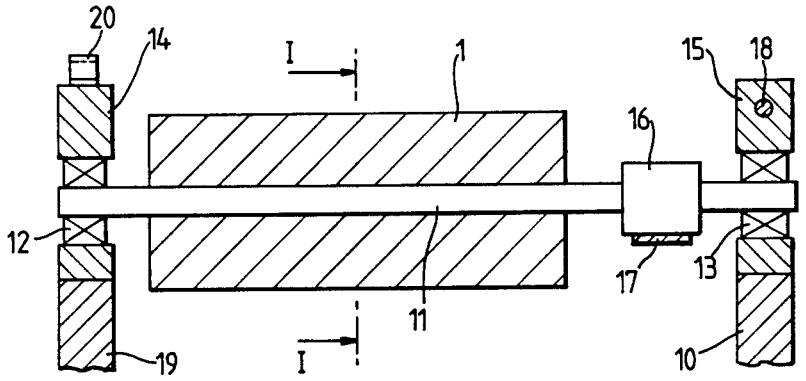
FIG. 2 is a section taken on the line II—II of FIG. 1.

FIG. 2 shows the pivot pin 18 and carrier 15 in more detail, and illustrates the fact that the bearings 12 and 13 at either end of the support shaft 11 for the solid roller 1 are carried by respective plates of which plate 15 forms the carrier illustrated in FIG. 1 and plate 14 is not shown in FIG. 1. The carrier plate 14 is provided with a spring 20 to hold it in the FIG. 2 configuration. Finally, the support shaft 11 for the roller 1 carries a pulley 16 frictionally engaged by a drive belt 17.

At the right hand side of the friction spinning unit within the casing 10 is a suction duct 21 which defines a generally downwardly extending hopper towards a separate hopper portion 22 at the lower end of the suction duct 21. This separate hopper 22 carries a rotary valve 23 which is mechanically linked to the mechanism for lifting the solid roller 1 by means of a mechanical interconnection schematically illustrated at 26 in FIG. 1. Finally, the valve 23 is linked to a source of suction (not shown) by way of a suction line 27.

The operation of cleaning the friction spinning unit will now be described.

When a yarn break occurs, the spinning unit cover (not shown) is opened and the carrier defined by the plates 14, 15 supporting the shaft 11 for the solid roller 1 is pivoted around the axis defined by pin 18, thereby effecting opening of the shut-off valve 23 between the lower hopper portion 22 and the suction line 27. This effects application of suction to the lower hopper portion 22 and allows any slub remaining there to be sucked away along the suction line 27 as the roller 1 is lifted.

Alternatively, the shut-off valve 23 may be actuated by rotation of the inner masking sleeve 24, or as the spinning unit cover is lifted, or by any other special control therefor.

Once the machine operative is satisfied that the yarn formation nip has been cleared, he or she simply closes the unit once more by lowering the solid roller 1, and automatically suction to duct 21 is cut off by closing the valve 23 by virtue of the mechanical interconnection schematically illustrated at 26. The spinning unit is then ready for a normal piecing cycle described in said Published European Patent Application No. 0 052 412. As indicated above, whereas it is advantageous for the present invention to be incorporated in the apparatus actually illustrated in said European Patent Application No. 0 052 412, there is of course considerable advantage in incorporating the slub removal facility in any open-end spinning machine incorporating means for opening and clearing the spinning unit.

The gap between the suction duct 21 and the separate lower hopper portion 22 serves both to ensure that the lower hopper portion and the suction duct do not foul when the spinning unit is fitted in the operating position, and also to provide for a constant intake of air during normal spinning operation for the purposes of keeping the valve body clear.

Although in the above description suction in the line 27 is used as the means for removing collected slubs from the receptacle comprising the suction-duct 21 and lower hopper portion 22, any alternative removal means such as a conveyor belt or a conveyor screen may be provided.

The suction line 27 in a multi-position machine may be common to all the spinning units along the machine.

Figure 3:
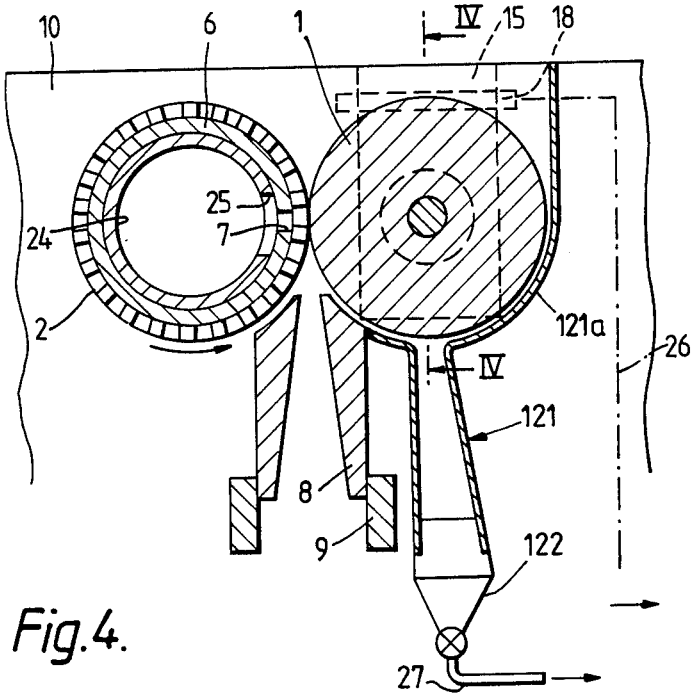
FIG. 3 is a view similar to FIG. 1 but showing an alternative embodiment of the suction duct for slub collecting.
Figure 4:
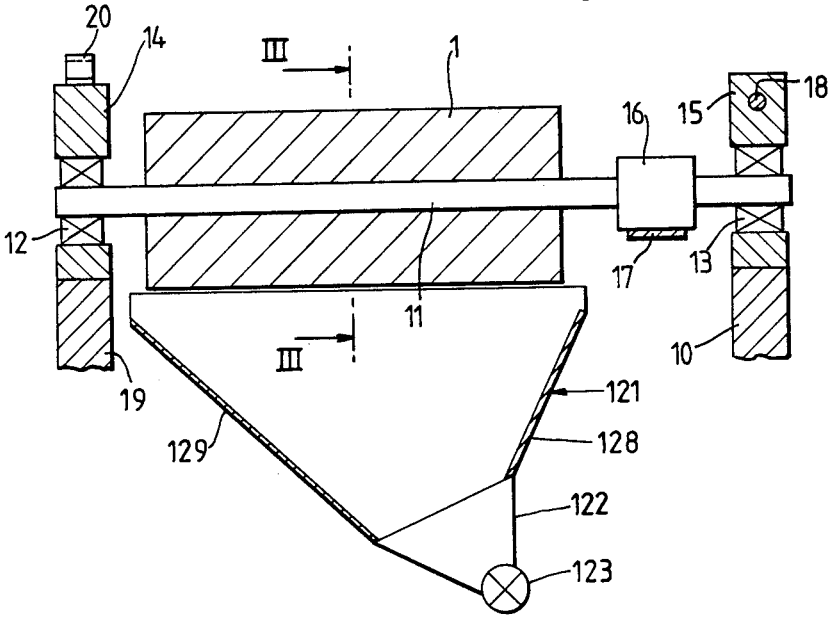
FIG. 4 is a section on the line IV—IV of FIG. 3.

In the alternative embodiment shown in FIGS. 3 and 4, FIG. 3 shows that the modified form of the suction duct 121 includes a portion 121*a* which follows the periphery of the imperforate roller 1 over a quarter of its surface and then extends upwardly as a vertical shield to confine the suction to the particular spinning unit shown in FIG. 3. It will of course be appreciated that in a multi-position friction spinning machine incorporating such friction spinning units the spinning rollers 1, 2 of one unit will be closely spaced from the corresponding spinning rollers of the next unit and thus the suction applied at the suction duct 121 shown in FIG. 3 could in the absence of the upwardly extending shield portion 121*a* interfere with the next friction spinning unit which will be running while any yarn break is repaired on the unit in question, resulting in a sudden application of suction to clear the accumulated slub as the imperforate roller 1 is lifted for cleaning the spinning unit.

FIG. 4, showing the same embodiment, illustrates the manner in which the side view of the suction duct 121 tapers asymmetrically so that the suction tends to be applied near one end of the imperforate roller 1, with the tendency that the slub lying on the yarn formation line will nose down into the suction hopper 122 to facilitate its entry into the suction valve 123.

To achieve this, the end wall 128 at the right hand side of FIG. 4 is steeper than the sloping end wall 129 at the left hand side of FIG. 3.

In order to avoid excessive throttling of the airflow down the suction duct 121 during slub clearing, as a result of the taper shown in FIG. 4, the cross-section as shown in FIG. 3 has a downwardly flaring characteristic which thereby tends to maintain a substantially constant flow cross-sectional area down the duct 121.

In this embodiment the suction duct 121 is a good fit on the hopper 122 so as to achieve maximum suction effect at the yarn formation line when the suction valve 123 is open.

A further consequence of the profile of the debris-receiving suction duct shown in FIG. 4 is that the upper end or mouth of the suction duct defines a gauge which will hold back any slubs which are too large to be sure to pass through the suction valve 123. In the event of such a slub being observed by the operator sitting astride the narrow inlet slot to the suction duct, the operator will simply remove that slub manually.

The close fitting curvature of the shield portion 121*a* around the periphery of the first friction spinning roller 1 has the effect of not only confining the suction to the one friction spinning unit in question, but also ensuring that the suction is effective to attract any loose fibres around the first friction spinning roller into the suction duct 121 as the first friction spinning roller 1 is lifted.

We claim:

1. A friction spinning unit including:

(a) first and second friction spinning rollers defining a yarn formation nip;

(b) means for opening the spinning unit for gaining access in order to remove fibrous debris in the event of a yarn break;

(c) debris receptacle means positioned alongside said first friction spinning roller to receive debris from the yarn formation nip;

(d) suction means effective to attract debris into said debris receptacle means;

(e) means actuating said suction means when the friction spinning unit is shut down for cleaning in the event of a yarn break;

(f) means for removing collected debris from said receptacle means; and (g) shield means integral with said debris receptacle means and closely following the periphery of said first friction spinning roller over a sector thereof for confining the application of suction to the periphery of said first friction spinning roller.

2. A friction spinning unit including:

(a) first and second friction spinning rollers defining a yarn formation nip;

(b) means for opening the spinning unit for gaining access in order to remove fibrous debris in the event of a yarn break;

(c) debris receptacle means positioned alongside said first friction spinning roller to receive debris from said yarn formation nip;

(d) suction means effective to attract debris into said debris receptacle means;

(e) means actuating said suction means when the friction spinning unit is shut down for cleaning in the event of a yarn break;

(f) means for removing collected debris from the receptacle means;

(g) first and second spaced end walls of said debris receptacle means having upper ends terminting adjacent the ends of said first friction spinning roller; and (h) first and second side walls of said debris receptacle means extending between said opposite ends of said first friction spinning roller, wherein said first and second end walls have differing angles of inclination with respect to said yarn formation nip and wherein said suction means open into said debris receptacle means at the foot of said first end wall of the debris receptacle means and nearer to said first end of the first friction spinning roller than to said second end thereof.

3. A friction spinning unit according to claim 2, wherein said first and second side walls of said debris receptacle means are mutually divergent in a direction away from said yarn formation nip and towards said suction means.

4. A friction spinning unit according to claim 2, wherein said debris-removing means comprise a hopper communicating with said receptacle means and having a discharge opening in a lower portion thereof, and a shut-off valve at said discharge opening of the hopper, wherein said suction means communicate with said debris receptacle means by way of said shut-off valve.

5. A friction spinning unit according to claim 4, including means mounting said first friction spinning roller for movement away from the second friction spinning roller in response to opening of the spinning unit, said debris receptacle means being arranged to clear slubs from the space occupied by the first roller in use of the friction spinning unit.

6. A friction spinning unit according to claim 4, wherein the means mounting said first roller for movement away from the second roller comprises pivot means for said first roller about an axis transverse to its axis of rotation and positioned near one end of the said one roller, and wherein the friction spinning unit includes a valve for communicating suction with said debris receptacle means, and an operative inter-connection between the roller moving means and said valve.

7. In a friction spinning unit including friction spinning roller means defining a yarn formation nip and means for opening the spinning chamber for gaining access in order to remove fibrous debris in the event of a yarn break; the improvement comprising:

(a) debris receptacle means positioned to receive debris from the friction spinning roller means;

(b) suction means effective to attract debris into said debris receptacle means;

(c) means actuating said suction means when the friction spinning unit is shut down for cleaning in the event of a yarn break;

(d) means for removing collected debris from the receptacle means; and (e) said debris receptacle means comprising first and second hopper parts defining a hopper having a bottom, with said suction means communicating with a valve in the bottom of said hopper serving as part of said suction actuating means, said hopper bottom being formed in said second hopper part and said first hopper part being disposed nearer to said yarn formation nip than is said second hopper part, and including means defining a gap between said first and second hopper parts to form an air passage therebetween.

* * * * *